US005383414A

United States Patent [19]

Winter et al.

[11] Patent Number: 5,383,414

[45] Date of Patent: Jan. 24, 1995

[54] APPARATUS FOR MAKING A THREE NEEDLE STITCH WITH COVER THREAD

[75] Inventors: Frank F. Winter, Prospect Heights; James M. Karaba, Jr., Rockford, both of Ill.

[73] Assignee: Union Special Corporation, Huntley, Ill.

[21] Appl. No.: 63,096

[22] Filed: May 17, 1993

[51] Int. Cl.[6] ..... D05B 1/20; D05B 57/06

[52] U.S. Cl. ..... 112/162; 112/100; 112/166

[58] Field of Search ..... 112/100, 162, 163, 165, 112/166, 167, 269.1, 197, 199, 200

[56] References Cited

U.S. PATENT DOCUMENTS

| | | | |
|---|---|---|---|
| 1,643,406 | 9/1927 | Finch | 112/441 |
| 1,681,458 | 8/1928 | Biddle | 112/199 |
| 1,855,254 | 4/1932 | Moffatt | 112/100 |
| 2,515,038 | 7/1950 | Harper | 112/441 |
| 3,776,157 | 12/1973 | Szostak | 112/162 |
| 4,117,792 | 10/1978 | Navlyt | 112/433 |
| 4,175,499 | 11/1979 | Navlyt | 112/165 |
| 4,671,195 | 6/1987 | Wolff et al. | 112/166 X |
| 5,233,935 | 8/1993 | Winter | 112/261 X |

FOREIGN PATENT DOCUMENTS

| | | | |
|---|---|---|---|
| 510149 | 10/1930 | Germany . | |
| 3346813C2 | 6/1984 | Germany . | |
| 3639390C2 | 2/1987 | Germany . | |
| 4000747C1 | 12/1990 | Germany . | |
| 753951 | 8/1980 | U.S.S.R. | 112/166 |

OTHER PUBLICATIONS

Two pages from a sewing machine manufacturer's, Yamato, publication including information relating to Yamato's pocket facing machine featuring an oscillating spreader thread eyelet.

One page from a sewing machine manufacturer's, Kansai, publication including information, W-8142 relating to Kansai's two needle, double chainstitch, flatbed machine with top cover thread, and W-8142-1/C-11 relating to Kansai's three needle, top cover, double chainstitch, flatbed machine with read chaincutter.

*Primary Examiner*—Clifford D. Crowder
*Assistant Examiner*—Paul C. Lewis
*Attorney, Agent, or Firm*—Willian Brinks Hofer Gilson & Lione

[57] ABSTRACT

A stitch and mechanism for forming such a stitch including three needles and cooperating loopers for forming three parallel rows of stitches that are joined by a spreader thread that lies on the upper surface of the work piece. The spreader thread is configuration to be on both sides of the three needles such that it connects and covers the three parallel rows of stitches.

12 Claims, 4 Drawing Sheets

64
84
86
78
80
82
168
70
76
90
106
114
96
98
100
102
104
107
92
94
88
112
116
108
110
120
122
124
126
130
132
134
138

APPARATUS FOR MAKING A THREE NEEDLE STITCH WITH COVER THREAD

BACKGROUND OF THE INVENTION

This invention relates to a new stitch that is formed along and covers the raw edge of an upper ply that is joined to a second underlying ply. The invention also relates to an improved apparatus for, and method of forming, the new stitch. The new stitch is useful in many applications including a pocket facing application.

This invention has particular application in the pocket facing operation on bluejeans. In this operation an upper layer or ply of denim is stitched, along a raw edge of the denim, to a pocket fabric ply.

In the prior art a pocket facing operation is performed by applying a facing stitch that has two parallel rows of standard Type 401 stitches with a top cover thread interlaced between the two rows of Type 401 stitches. In this prior art pocket facing operation, the stitch extends straight for a short distance, then follows a radius for about 90° and then extends straight for another short distance. The prior art facing stitch is started with the right needle at the raw edge of the upper ply of material, and as the stitch is formed around the radius, the line of Type 401 stitches formed by the right needle drifts to the left such that the raw edge of the upper ply of material is left uncovered by the facing stitch. As the garment is worn and washed the uncovered raw edge unravels and becomes unsightly.

SUMMARY OF THE INVENTION

In accordance with the present invention there is provided a stitch for securing together two superimposed workpieces along a raw edge of one of the workpieces. The stitch comprises three continuous upper needle threads, three lower looper threads and a spreader thread. Corresponding upper needle and lower looper threads form three parallel rows of standard Type 401 stitches. The spreader thread lies along the upper surface of the fabric and is interwoven between and connects the three rows of Type 401 stitches. When using this stitch in a pocket facing operation the row of Type 401 stitch to the right is applied to the right of the raw edge of the upper ply of fabric so that the stitch covers the raw edge of the fabric. The stitch of the present invention is produced by employing three fabric penetrating thread carrying needles, which are positioned with the left and right needles equally spaced from the center needle.

The three needles lie in a vertical plane which is at an acute angle to the direction of material feed such that the right needle trails the central needle and the central needle trails the left needle. The point of the left and center needles are on the same horizontal plane and the point of the right needle is about ⅛ of an inch above this horizontal plane. The three thread carrying needles introduce first, second and third continuous needle threads through the workpiece. The respective needle threads are formed into first, second and third needle thread loops which are formed on the underside of the workpiece. Three oscillating thread carrying loopers interloop looper threads with the first second and third needle loops for securing the latter in the workpiece thereby uniting or joining the superimposed workpieces.

In a preferred embodiment, the point of the right needle is disposed in a horizontal plane that is above the horizontal plane of the points of the center and left needles. The staggered arrangement of the needle points is compensated for by arranging the oscillating loopers to be at levels corresponding to the needle points.

A standard spreader, an auxiliary spreader, a spreader thread eyelet and a spreader thread guide are coordinated to lay a cover thread on the top surface of the workpiece plies. In this operation, the cover thread interweaves between the three rows of the 401 Type stitch and thus covers the raw edge of the upper ply.

The new stitch of this invention provides superior coverage to the raw edge of the denim and increases the seam strength as a result of the additional row of Type 401 stitch which increases the width of the stitch by 50%.

DETAILED DESCRIPTION OF THE PREFERRED EMBODIMENT

Figure 1:
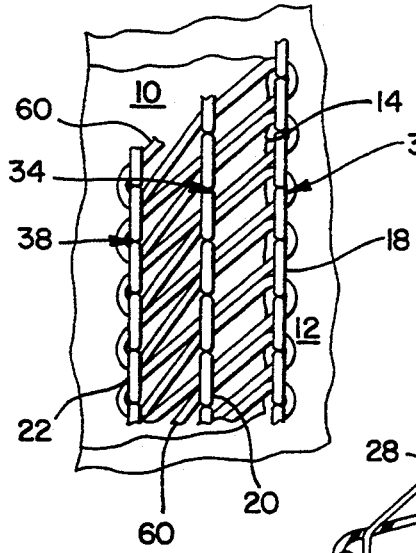
FIG. 1 is a plan view of the stitch applied to overlapping plies of material.

FIG. 1 is a plan view of the stitch of this invention when applied to an overlapping ply of material. During the formation of this stitch, two plies of material to be joined are fed through the machine in overlapping relationship, with an upper ply of material 10 located with its edge 14 extending along a non-edge piece of a lower ply 12. Thus the upper ply of material extends toward the left of its edge 14 and the lower ply 12 extends to the right and the left of edge 14. The stitch spans the edge 14 of the upper ply of material 10 to secure the upper and lower plies and to cover the raw edge 14. When applied to bluejeans, the upper ply 10 is denim material and the lower ply 12 is pocket facing material.

Figure 2:
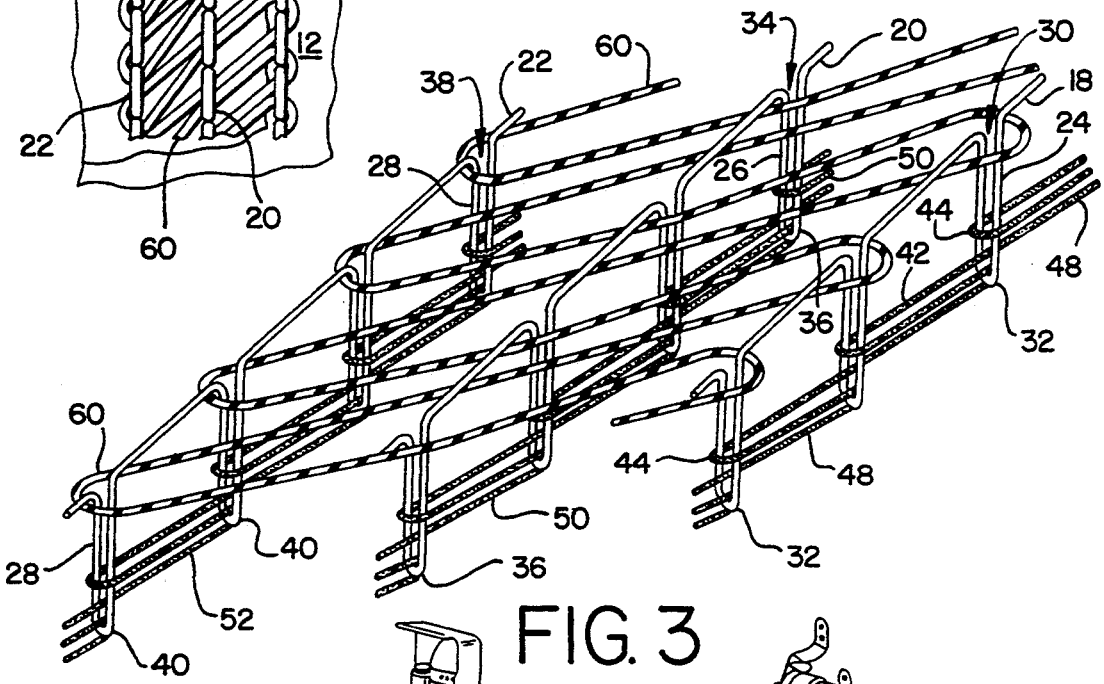
FIG. 2 is a three dimensional rendering of the threads comprising the stitch.

FIG. 2 is a three dimensional illustration of the threads comprising the stitch of this invention. The stitch includes three needle threads 18, 20 and 22, three looper threads 48, 50 and 52 and a spreader thread 60. The material plies that are joined by the stitch have not been included in FIG. 2 to better illustrate the stitch formation. The stitch comprises three continuous upper or needle threads 18, 20 and 22 which are formed into right 24, middle 26 and left 28 loops respectively. The needle threads extend along lines that are laterally offset from each other and generally parallel to the edge 14 of the upper ply of material 10.

Referring now to FIGS. 1 and 2, the right loop 24 of right needle thread 18 passes downwardly from its penetration point 30 through the lower ply 12 of material and extends downwardly to locate the bight portion 32 of the right loop 24 beneath the penetration point 30. The middle loop 26 of middle needle thread 20 passes downwardly from its penetration point 34 through both the upper ply 10 and the lower ply 12 of material and extends downwardly to locate the bight portion 36 of the middle loop 26 beneath the penetration point 34. The left loop 28 of thread 22 passes downwardly from its penetration point 38 through both the upper ply 10 and the lower ply 12 of material and extends downwardly to locate the bight portion 40 of the left loop 28 beneath the penetration point 38.

A lower right looper thread 48 is formed into a loop 42 that passes through the bight portion 32 of the right loop 24 and as the material is advanced the bight portion 44 of loop 42 is open and below the penetration point 30 of the next successive stitch of the right needle thread 18. Thus the bight portion 44 is penetrated by loop 24 of the next stitch formed by thread 18. Thus the right needle thread 18 and the right looper thread 48 form a standard Type 401 stitch. This first row of Type 401 stitch is formed through only the lower ply 12 of material and follows along the raw edge 14 of the upper ply of material 10. The middle and left needle threads 20 and 22 cooperate respectively with middle and left looper threads 50 and 52 in the same manner as described above for right needle thread 18 and right looper thread 48 to form standard Type 401 stitches that extend through both the upper 10 and lower 12 plies of material.

A cover or spreader thread 60 is cast on the upper surface of the superimposed workpieces 10 and 12 and interlaced between the needle threads 18, 20 and 22 such that it follows a serpentine path and ties the three standard Type 401 stitches together. As the stitch is being sewn, the spreader thread 60 is cast such that it is in front of the left needle 82 and center needle 80 and behind the right needle 78. (See FIGS. 5 and 5*a*) Thus, in the stitch, the spreader thread 60 is located in front of penetration points 38 and 34 for needle threads 22 and 20, and behind penetration point 30 for needle thread 18. The spreader thread pattern ties the three rows of Type 401 stitches together to form a very effective and useful new stitch.

Figure 3:
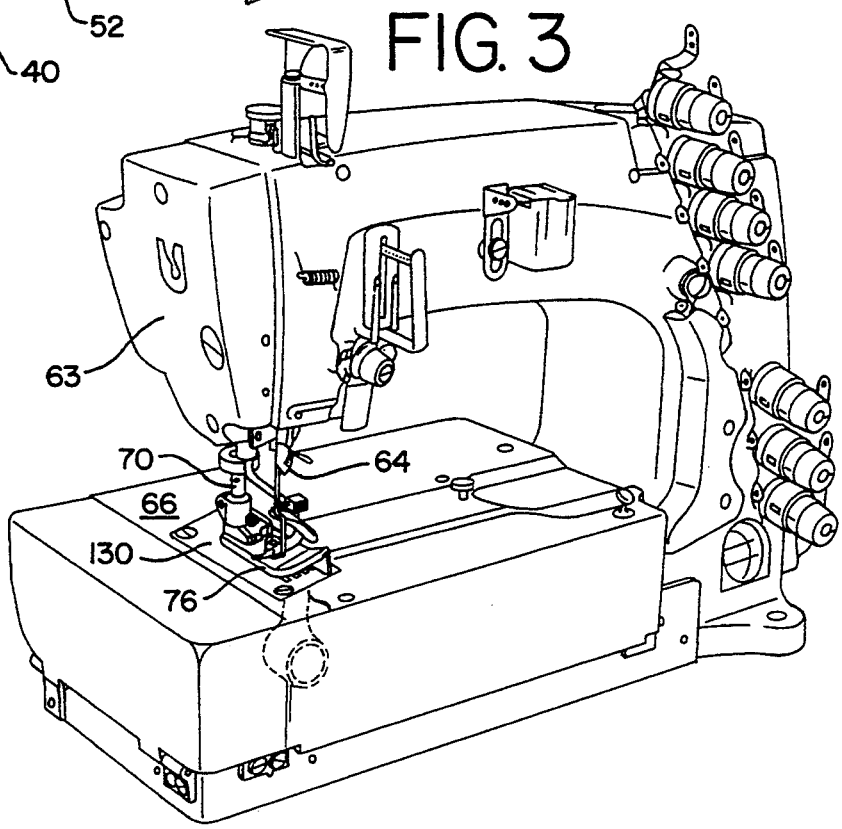
FIG. 3 is a perspective view of a sewing machine of the type that could produce the stitch.

FIG. 3 is a perspective view of a sewing machine 62 of the type that may be used to produce the stitch of this invention. Sewing machine 62 includes a head 64, a work supporting surface 66, a reciprocating needle bar 68 (not shown), a presser foot bar 70 and a throat plate 130. A needle head 64, carrying three needles 78, 80 and 82 (FIG. 5*a*), is secured to the lower end of the needle bar 68 and a presser foot 76 is carried by the lower end of presser foot bar 70. The looper rocker 142 is located below the work supporting surface 66 and is shown in broken lines in this view to depict its relative location in the sewing machine.

Figure 4B:
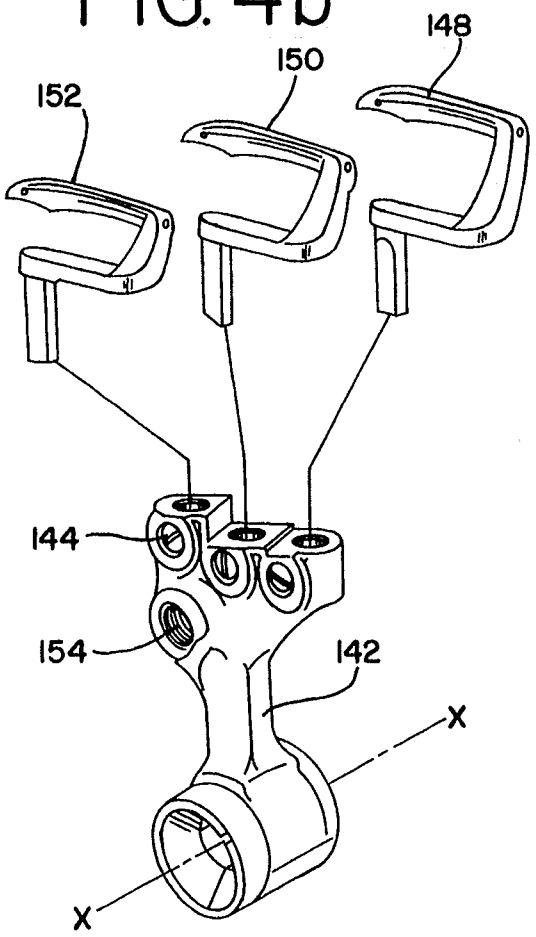
FIG. 4*b* is an isolated perspective view of the looper rocker with the three loopers displaced away from the rocker.
Figure 4:
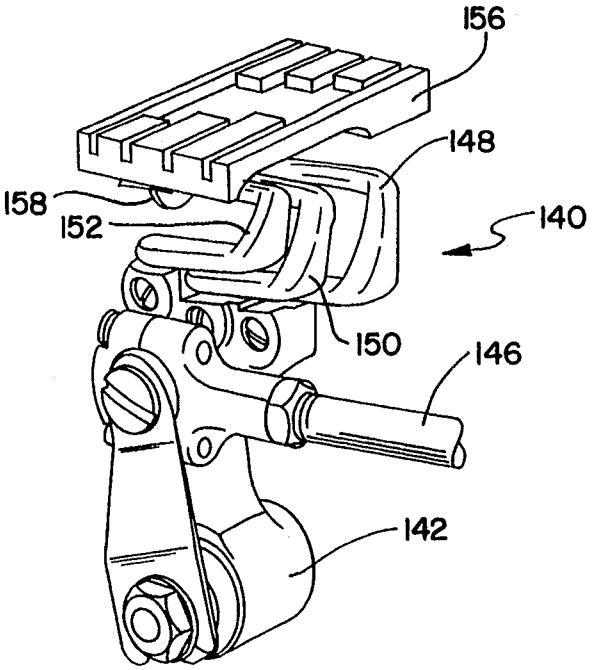
FIG. 4 is a composite view of the oscillating loopers used to produce the stitch.
Figure 4A:
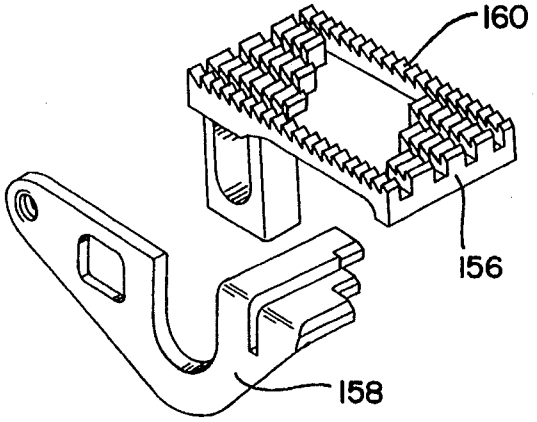
FIG. 4*a* is an isolated perspective view of the feed dog and needle guard.

Referring now to FIGS. 4, 4*a* and 4*b*, a set of loopers 140 is mounted for reciprocal movement below the work supporting surface 66. In FIG. 4 the assembled set of three loopers, right looper 148, middle looper 150 and left looper 152 are shown mounted on the looper rocker 142. The loopers 148, 150 and 152 are secured in adjusted position in the looper rocker 142 by set screws 144. Looper 152 is the front or first looper when looking in the direction of material travel. The loopers are set at a 3/16 inch looper gauge. Viewing from the top, looper 150 is the middle or second looper and its point is about 3/16 of an inch to the right of the point of looper 152. Looper 148 is the rear or third looper and its point is about 3/16 of an inch to the right of the point of looper 150. Viewing from the front, the point of looper 148 is elevated from the points of loopers 150 and 152 by about ⅛ of an inch.

The looper rocker 142 is mounted for oscillating motion on the sewing machine frame about a pivot axis X—X. Conventional looper rockers that have complex motions, such as a rocking motion or an axial motion in addition to an oscillating motion, could also be used. A rocker arm 146 is connected to the looper rocker 142 at threaded bore 154 to impart a rocking or oscillating motion to the looper rocker 142.

FIG. 4*b* shows the looper rocker 142 isolated from the other mechanism with the loopers 148, 150 and 152 removed. It is apparent in this view that the loopers 148, 150 and 152 are staggered from front to back. Looking into the direction of work material feed, the left looper 152 is in the foreground, the middle looper 150 is behind the left looper 152 and the right looper 148 is behind the middle looper 150.

The sewing needles 76, 78 and 80 are staggered in the direction of the material feed to permit cooperation between each needle and its associated looper during each stitch. (See FIGS. 5 and 5*a*) Thus, the point of right needle 78 is at a level higher than the points of the left and middle needles 82 and 80 to cooperate with looper 148 which is at a higher level than loopers 150 and 152. As a result, the right needle 78 will penetrate the work material after penetration by the left 82 and middle 80 needles.

The feed dog 156 in FIG. 4 is located above the set of loopers 140. For simplicity, feed dog 156 is not shown with feed teeth, as in FIG. 4*a*. Also in FIG. 4 a portion of the needle guard 158 is visible.

In FIG. 4*a* the feed dog 156 and the needle guard 158 are shown isolated from the stitch forming mechanism. Feed teeth 160 are located at the top surface of the feed dog 156. The needle guard 158 protects and prevents the needles 78, 80 and 82 from being deflected behind the loopers 148, 150 and 152.

Figures 5, 5A, 5B, 5C, 5D, 5E, 5F:
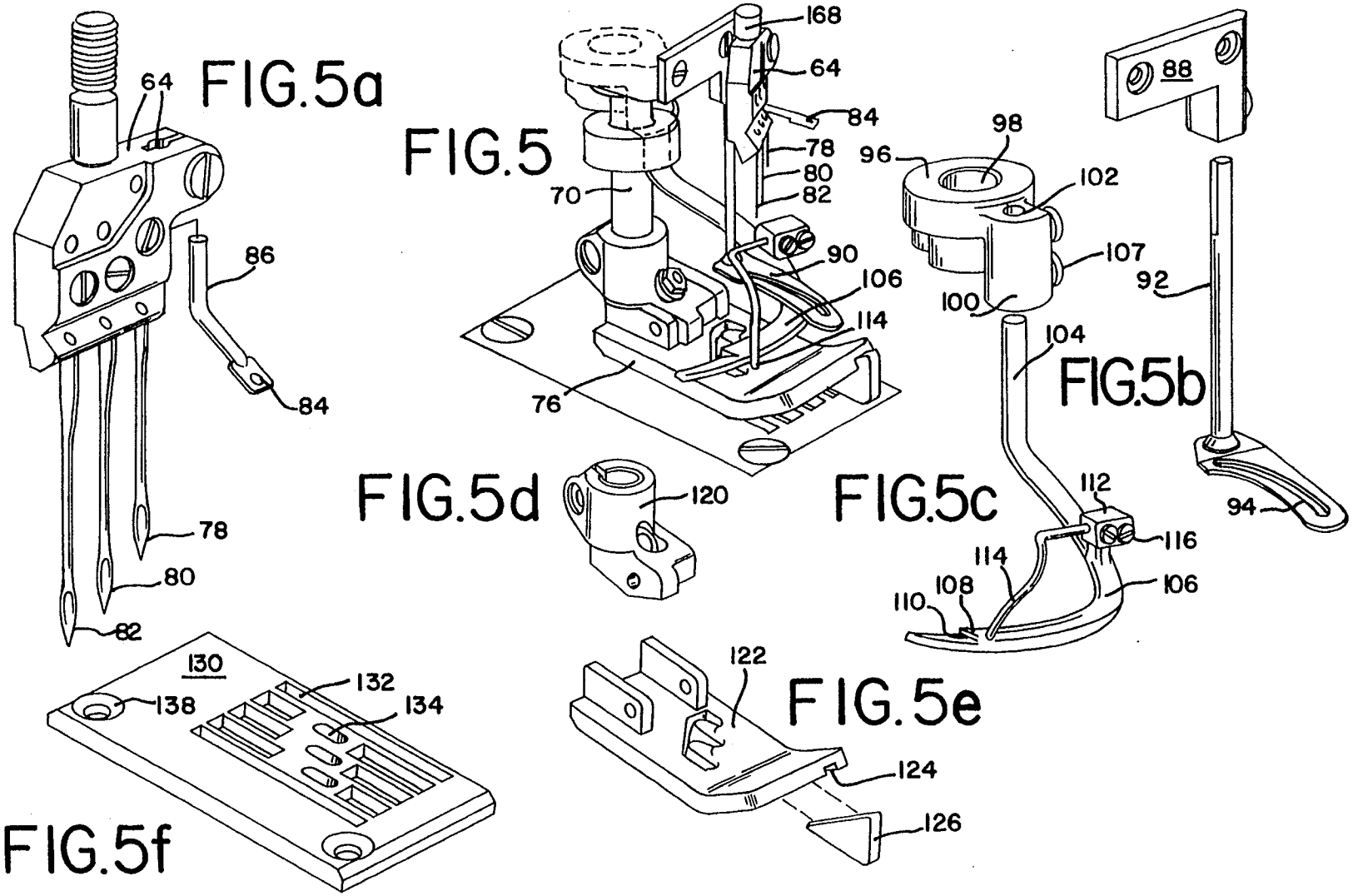
FIG. 5 is a composite view of stitch forming components that are above the work support surface.
FIG. 5*a* is an isolated perspective view of the needle head.
FIG. 5*b* is an isolated perspective view of the spreader thread guide and its mounting plate.
FIG. 5*c* is an isolated perspective view of the spreader and auxiliary spreader and its holder.
FIG. 5*d* is an isolated perspective view of the presser foot shank.
FIG. 5*e* is an isolated perspective view of the presser foot bottom including the presser foot keel.
FIG. 5*f* is an isolated perspective view of the throat plate.

FIGS. 5, 5*a*, 5*b*, 5*c*, 5*d*, 5*e* and 5*f* illustrate the stitch forming components generally shown in FIG. 3 that are located above the work supporting surface 66. FIG. 5 is a composite view of all these components in assembled condition and FIGS. 5*a* through 5*f* are isolated views of individual components. The needle head 64 carries three needles, right needle 78, middle needle 80 and left needle 82. The point of right needle 78 is at a higher elevation than the points of left needle 82 and middle needle 80. As shown in FIG. 5, the needle head 64 is at an acute angle to the direction of material travel such that right needle 78 is the trailing needle and left needle is the leading needle. A spreader thread eyelet 84, through which spreader thread 60 passes, is carried at the end of a rod 86 that is adjustably carried by the needle head 64. The spreader thread eyelet 84 reciprocates along with the needle bar 68.

As shown in FIG. 5*b*, a spreader thread guide mounting plate 88, that is secured to the sewing head area 72 (see FIG. 3), and functions to mount the spreader thread guide 90 at the end of rod 92. The spreader thread guide 90 has an elongated arcuate shaped slot 94 formed therein. The spreader thread guide 90 remains stationary during the formation of a stitch.

FIG. 5*c* shows a spreader holder 96 having a vertical cylindrical bore 98 which is mounted for oscillation about a bushing (not shown) within the head of the sewing machine. An oscillator (not shown) causes the spreader holder 96 to oscillate. A lug 100 protrudes radially from the spreader holder 96. The lug 100 has a vertical bore 102 that is sized to receive the top end of the spreader mounting bar 104. A pair of set screws 107 is threaded into lug 100 to lock the spreader in a selected position. The spreader 106, is carried at the bottom end of spreader mounting bar 104, and has a generally arcuate shape and lies in a horizontal plane. The spreader 106 has a thread carrying notch 110 including a point 108 formed thereon. The thread carrying notch 110 is useful in casting the spreader thread 60 in a serpentine path on the upper surface of the work material.

A mounting hub 112 protrudes upwardly from the spreader 106 and serves to mount an auxiliary spreader 114. The auxiliary spreader comprises a curved wire which extends from mounting hub 112 toward the spreader 106. The auxiliary spreader terminates approximately at thread carrying notch 110. Set screws 116 adjustably secure auxiliary spreader 114 in the mounting hub 112. The operation of the spreader 106 and auxiliary spreader 114 will be explained with reference to FIGS. 6–9.

Referring now to FIGS. 5*d* and 5*e*, the presser foot 76 includes a shank 120 and a bottom portion 122 which is mounted on the shank 120 for pivoting about a horizontal pivot axis. The front end of the presser foot bottom portion 122 is inclined and includes a slot 124 that receives the mounting edge of a presser foot keel 126.

The throat plate 130 depicted in FIG. 5*f* has a plurality of feed dog openings 132 and a set of needle openings 134. The throat plate 130 is set into the work supporting surface 66 and is secured thereto by screws 136 that extend through countersunk holes 138 formed in the throat plate 130.

FIGS. 6, 7, 8, and 9 are a series of views showing the progressive locations of spreader 106 and the auxiliary spreader 114 as the spreader thread 60 is cast along the upper surface of the work material and interlooped with the needle threads 18, 20 and 22. Needles 78, 80 and 82 are shown to illustrate their location relative to the spreader thread 60.

Figure 6:
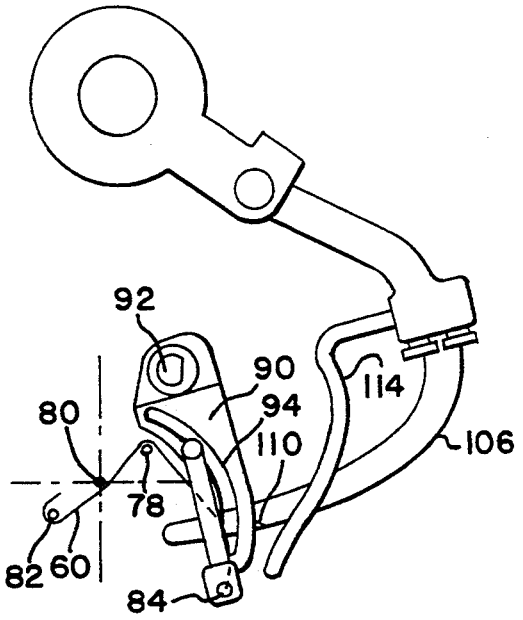
FIG. 6 is a plan view of the start of forward motion of the spreader.

FIG. 6 shows the spreader 106 at its extreme right position when it is about to start its forward motion (to the left). At this point in the cycle, the needle bar 68 is at the bottom of its stroke and the spreader thread 60 extends up from right needle 78, across the front edge of spreader 106, through the arcuate shaped slot 94 in the spreader thread guide 90, through the spreader thread eyelet 84 and from there to its source. The eyelet 84 constrains thread 60 to the end of arcuate shaped slot 94 located at the free end of spreader thread guide 90.

Figure 7:
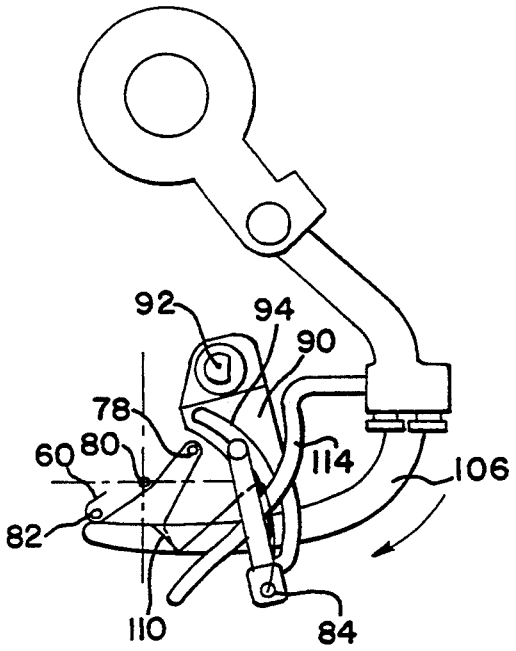
FIG. 7 is a plan view of the middle of forward motion of the spreader.

FIG. 7 shows the spreader 106 in the middle of its forward motion and moving to the left as shown by the directional arrow. At this point in the cycle the needle bar 68 is rising and is located between the bottom and top of its stroke. From the position in FIG. 6, the spreader thread 60 has slid along the rear edge of spreader 106 and has encountered thread carrying notch 110. Notch 110 catches spreader thread 60 and holds it from further movement along the edge of spreader 106. After spreader thread 60 encounters thread carrying notch 110, further movement to the left by spreader 106 causes the spreader thread 60 to be pulled to the left. At this stage of the cycle, auxiliary spreader 114 has encountered spreader thread 60. The auxiliary spreader 114 causes the thread to slide along the arcuate shaped slot 94, moving thread 60 toward the rear end of slot 94.

Figure 8:
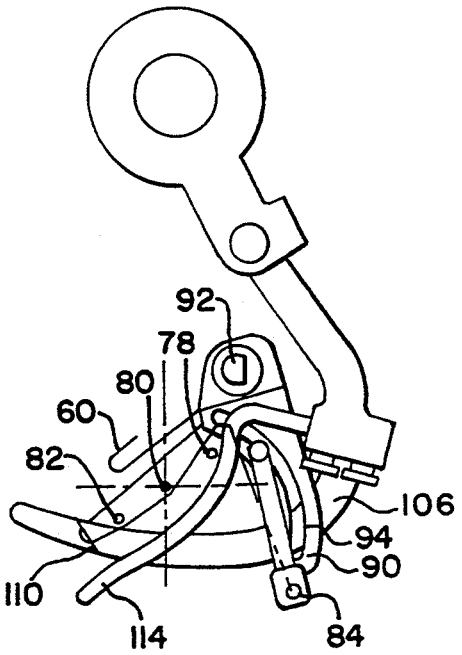
FIG. 8 is a plan view of the end of forward motion of the spreader.

FIG. 8 shows the spreader 106 at the end of its forward motion and at its extreme left position. At this point in the cycle the needle bar 68 is at the top of its stroke. The spreader thread 60 remains in contact with the thread carrying notch 110 of the spreader 106 and the auxiliary spreader 114 has caused the spreader thread 60 to move past the tip of the right needle 78. As the needle bar 168 moved up from its position in FIG. 7, thread 60 passed under the point of needle 78 while in engagement with the front surface of needles 80 and 82. The thread 60 was moved in this manner because the point for needle 78 is at a higher elevation than the point for needles 80 and 82. This movement of the thread 60 beneath needle 78 is caused by the action of the auxiliary spreader 114 directing spreader thread 60 toward the extremity of arcuate shaped slot 94. Immediately after the needles 78, 80 and 82 reach the top of their cycle they reverse direction, and needles 80 and 82 penetrate the work material on one side of thread 60 and needle 78 penetrates the work material on the opposite side thereof. Needles 80 and 82 pierce the fabric first and prevent the thread 60 from being moved to a location on their back side.

Figure 9:
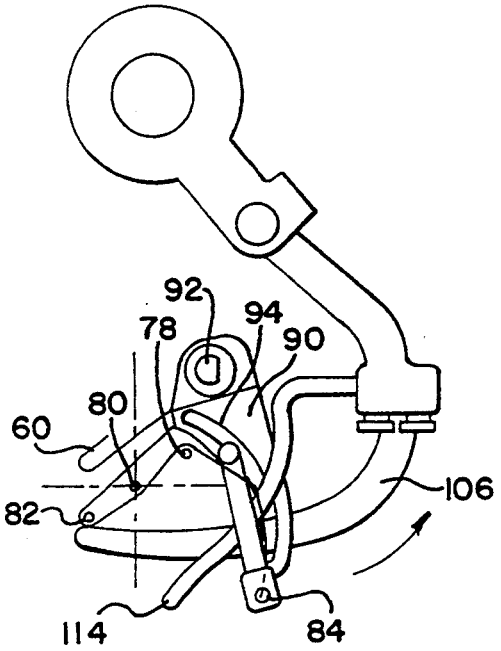
FIG. 9 is a plan view of the middle of the return motion of the spreader.

FIG. 9 shows the spreader in the middle of its return motion and is moving to the right, as shown by the directional arrow. Here the needle bar 68 is moving down. When the spreader 106 reverses its direction the thread 60 is released from the notch 110. As shown in FIG. 9, thread 60 extends from around needle 78 upwardly through the arcuate shaped slot 94, over the left or rear surface of the auxiliary spreader 114, and through the spreader thread eyelet 84. As the auxiliary spreader 114 sweeps to the right, it engages the thread 60 and allows it to slide along the edge of the arcuate shaped slot 94 toward its terminal end, while motion is caused by the eyelet 84. When the spreader 106 reaches its extreme right position (FIG. 6) the thread 60 will have slid off the terminal end of the auxiliary spreader, and the spreader components will have completed a cycle and will have returned to the positions shown in FIG. 6.

While the invention has heretofore been described in detail with particular reference to illustrated apparatus and seams, it is to be understood that variations, modifications and the use of equivalent mechanisms can be effected without departing from the spirit and scope of this invention. It is, therefore, intended that such changes and modifications be covered by the following claims.

What is claimed is:

1. A stitch forming mechanism for forming a flat seam comprising:

three needles reciprocating in a vertical plane and each carrying a needle thread, a throat plate having a work supporting surface lying in a horizontal plane and having openings for passage of said plurality of needles therethrough, three loopers disposed beneath said throat plate for cooperation with said needles to form three parallel rows of stitches, each looper carrying a looper thread, a spreader operating above said throat plate for casting a cover thread into loops, and an auxiliary spreader connected to and cooperating with said spreader to form said cover thread loops in a configuration for penetration, on both sides of said cover thread loops, by said three reciprocating needles.

2. The invention as set forth in claim 1 in which said stitch forming mechanism further includes a thread guide fixed in a position closely overlying said spreader, and a thread eyelet mounted above said thread guide for movement with said needles vertically toward and from said thread guide, said thread guide having an arcuate shaped slot formed therein, said cover thread extending downwardly through said eyelet, through said arcuate shaped slot, across the path of said spreader and then down to the previous stitch, the combined motions of said spreader, said auxiliary spreader and said eyelet relative to said arcuate shaped slot causes said cover thread to slide between positions at opposite ends of said arcuate shaped slot to thus direct said cover thread to follow a serpentine path between said three needles.

3. The invention as set forth in claim 1 wherein the connection of said auxiliary spreader to said spreader permits adjustment of the auxiliary spreader relative to the spreader.

4. A sewing machine for producing a stitch comprising three rows of closely and equally spaced stitches, each row of stitches formed from a needle thread and a looper thread, and wherein the mechanism for producing this stitch includes:

a reciprocating needle bar;

a throat plate having feed dog openings formed therein;

a feed dog including material engaging portions adapted to extend through said feed dog openings to advance the material in the direction of material feed;

a needle head mounting three needles, said three needles laying in a vertical plane and the point of the right needle being at a higher elevation than the corresponding points of the left and the middle needles;

said needle head being secured to said needle bar such that said vertical plane of said needle head is at an acute angle to the direction of material feed;

a looper rocker, mounted to pivot about an axis that is parallel to said direction of material feed, said looper rocker carrying three loopers, each arranged to cooperate with one of said needles and each having a looper point;

the looper point, of the looper arranged to cooperated with the left needle, spaced from the looper point of the looper arranged to cooperate with the middle needle, by an amount corresponding to the spacing between the left and middle needles;

the looper point, of the looper arranged to cooperated with the middle needle, spaced from the looper point of the looper arranged to cooperate with the right needle, by an amount corresponding to the spacing between the middle and right needles; and the point of the looper arranged to cooperate with the right needle is located in the radial direction relative to the looper rocker pivot axis further from the looper rocker axis than the points of the loopers arranged to cooperate with the left and middle needles.

5. The invention as set forth in claim 4 wherein said left and right row of lock stitch are each about 3/16 of an inch from said middle row.

6. The invention as set forth in claim 4 wherein the point of the looper arranged to cooperate with the right needle is about ⅛ of an inch in the vertical direction further from the looper rocker axis than the point of the loopers arranged to cooperate with the left and middle needles.

7. The invention as set forth in claim 5 wherein the point of the looper arranged to cooperate with the right needle is about ⅛ of an inch in the vertical direction further from the looper rocker axis than the point of the loopers arranged to cooperate with the left and middle needles.

8. A sewing machine for producing a stitch comprising, three rows of closely and equally spaced stitches, each row of stitches being formed from a needle thread and a looper thread; and a spreader thread interlaced with the three rows of stitches; wherein the mechanism for producing this stitch includes:

a reciprocating needle bar;

a throat plate having feed dog openings formed therein;

a feed dog including material engaging portions adapted to extend through said feed dog openings to advance the material in the direction of material feed;

a needle head mounting three needles, said three needles laying in a vertical plane and the point of the right needle being at a higher elevation than the corresponding points of the left and the middle needles;

said needle head being secured to said needle bar such that said vertical plane of said needle head is at an acute angle to the direction of material feed;

a looper rocker, mounted to pivot about an axis that is parallel to said direction of material feed, said looper rocker carrying three loopers, each arranged to cooperated with one of said needles and each having a looper point;

the looper point, of the looper arranged to cooperated with the left needle, is spaced from the looper point of the looper arranged to cooperate with the middle needle, by an amount corresponding to the spacing between the left and middle needles;

the looper point, of the looper arranged to cooperated with the middle needle, is spaced from the looper point of the looper arranged to cooperate with the right needle, by an amount corresponding to the spacing between the middle and right needles; and oscillating spreader mechanism, including an auxiliary spreader that is connected thereto, for casting said spreader thread such that it is interwoven by the stitches formed by said three needles.

9. The invention as set forth in claim 8 wherein said left and right row of stitches are each about 3/16 of an inch from said middle row.

10. The invention as set forth in claim 8 wherein the point of the looper arranged to cooperate with the right needle is about $\frac{1}{8}$ of an inch in the radial direction further from the looper rocker axis than the point of the loopers arranged to cooperate with the left and middle needles.

11. The invention as set forth in claim 9 wherein the point of the looper arranged to cooperate with the right needle is about $\frac{1}{8}$ of an inch in the radial direction further from the looper rocker axis than the point of the loopers arranged to cooperate with the left and middle needles.

12. The invention as set forth in claim 8 wherein the connection of said auxiliary spreader to said oscillating spreader mechanism permits adjustment of the auxiliary spreader relative to the oscillating spreader mechanism.

* * * * *